US006109582A

United States Patent [19]

Repaci et al.

[11] Patent Number: 6,109,582

[45] Date of Patent: Aug. 29, 2000

[54] PRODUCT SHIPPING AND DISPLAY STRIP SYSTEM

[76] Inventors: Louis E. Repaci, 4760 Cannington Dr., San Diego, Calif. 92117; Gerald E. Robinson, 33963 Upper Bear Creek Rd., Evergreen, Colo. 80439

[21] Appl. No.: 09/395,464

[22] Filed: Sep. 14, 1999

Related U.S. Application Data

[63] Continuation-in-part of application No. 09/017,111, Jan. 31, 1998, abandoned.

[51] Int. Cl.[7] ..... A47H 1/10

[52] U.S. Cl. ..... 248/317; 211/72; 211/113; 206/45.24; 206/372; 206/482

[58] Field of Search ..... 248/205.3, 317, 248/318; 211/71, 72, 113, 118; 206/482, 763, 372, 806, 466, 461, 756, 45.24

[56] References Cited

U.S. PATENT DOCUMENTS

| | | | |
|---|---|---|---|
| D. 302,918 | 8/1989 | Maki | D6/572 |
| 4,200,945 | 5/1980 | Ellis | 206/450 |
| 4,761,902 | 8/1988 | Lansky et al. | 40/155 |
| 4,767,012 | 8/1988 | Simmons | 211/89 |
| 4,817,805 | 4/1989 | Rodriquez | 211/71 |
| 4,832,301 | 5/1989 | Hiramoto et al. | 248/359 |
| 5,103,970 | 4/1992 | Nielson et al. | 206/45.14 |
| 5,328,137 | 7/1994 | Miller et al. | 248/223.4 |
| 5,405,022 | 4/1995 | Rissley | 211/59.1 |

*Primary Examiner*—Ramon O. Ramirez
*Assistant Examiner*—Gwendolyn Baxter

[57] ABSTRACT

A shipping and display system product shipping and display strip system displaying items, or product, at retail store check out counters and high traffic areas. The system includes an elongate flexible strip with an upper end designed for suspending from a structure. On the front surface of the strip are a plurality of spaced apart adhesive areas. Each of the adhesive areas has an adhesive on it for adhesively coupling an object to it.

14 Claims, 4 Drawing Sheets

PRODUCT SHIPPING AND DISPLAY STRIP SYSTEM

CROSS REFERENCE TO RELATED APPLICATION

This application is a continuation-in-part of Application Ser. No. 09/017,111, filed Jan. 31, 1998, now abandoned.

BACKGROUND OF THE INVENTION

1. Field of the Invention

The present invention relates to devices for arranging and displaying objects and more particularly pertains to a new product shipping and display system for attachment to a plurality of similar products for shipping and for displaying the products subsequent to shipping.

2. Description of the Prior Art

The use of devices for arranging and displaying objects is known in the prior art. More specifically, devices for arranging and displaying objects heretofore devised and utilized are known to consist basically of familiar, expected and obvious structural configurations, notwithstanding the myriad of designs encompassed by the crowded prior art which have been developed for the fulfillment of countless objectives and requirements.

Known product display systems include elongate display structures to which a plurality of products are attached at locations along the length of the elongate structure for displaying the products in a linear array at a point of sale. However, the known elongate display structures have presented numerous problems to manufacturers and retailers.

If the products are attached to the display structure after shipping to the retailer, the retailer must devote an employee's time to attaching the products to the display structure. Preferably, the products are attached to the display structure prior to shipping the products to the retailer. However, if the products are attached to the display structure at some point prior to shipping, then shipping can be a problem if conventional shipping packaging, such as generally cubical boxes, are used. Special and generally non-standard packaging containers, such as long and thin and flat boxes, are generally required for shipping the products and the elongate display structures. Because of this special packaging requirement, the product must often be moved to a location relatively remote from the manufacturing location for the process of attaching the products to the strip and the specialized packaging process. This adds further expense to shipping costs, especially when the products must be packaged in conventional boxes for shipping between the factory and the place of attaching the products to the display structure and final packaging for shipping to the retailer.

As yet a further complication, if the products are not of a generally flat nature, each product must often be attached to a specialized card or other packaging device primarily for the purpose of permitting the product to be feasibly attached to the display structure.

The aforementioned factors, among others, have made the use of elongate display structures cumbersome and unnecessarily expensive for the manufacturer and the retailer.

SUMMARY OF THE INVENTION

In view of the foregoing disadvantages inherent in the known types of devices for arranging and displaying objects now present in the prior art, the present invention provides a new product shipping and display strip system wherein the same can be utilized displaying items, or product, at retail store check out counters and high traffic areas.

The general purpose of the present invention, which will be described subsequently in greater detail, is to provide a new product shipping and display strip system which has many of the advantages of the devices for arranging and displaying objects mentioned heretofore and many novel features that result in a new product shipping and display strip system which is not anticipated, rendered obvious, suggested, or even implied by any of the prior art devices for arranging and displaying objects, either alone or in any combination thereof.

To attain this, the product shipping and display strip of the present invention generally comprises an elongate flexible display strip having front and back surfaces, and a longitudinal axis extending between upper and lower ends. A plurality of areas on the front surface of the display strip have adhesive applied to the front surface, with each of the adhesive areas being for adhesively coupling a product to the front surface such that an array of products is created along the display strip with a longitudinal extent of the products being generally aligned with the longitudinal axis of the display strip.

Each of the adhesive areas is spaced along the longitudinal direction of the display strip by a distance between adjacent adhesive areas. The distance between adjacent adhesive areas is adapted such that in a linear configuration of the display strip, substantially the entire length of the products may abut against the display strip without adjacent products overlapping each other and thereby preventing the bending of the display strip into a serpentine condition with the products attached. The distance between adjacent adhesive areas is adapted to permit longitudinal spacing between adjacent products attached to the front surfaces of the display strip.

The length of each of the adhesive areas in the longitudinal direction of the display strip is adapted to permit a portion of the display strip between adjacent products to flex away from the adjacent products into an accordion configuration such that products attached to the display strip may be positioned in a shipping box in a parallel orientation to each other with adjacent products on the display being abuttable against each other.

A preferred product shipping and display strip structure includes the elongate flexible display strip, a plurality of shielding segments adhered to the display strip, and a protective strip positioned adjacent to the front surfaces of the display strip with the shielding segments being interposed between the protective strip and the display strip. Each of the shielding segments is positioned between adjacent adhesive areas for shielding products adhered to the adhesive areas from contact with any adhesive on the front surface of the display strip between the adhesive areas. The protective strip is releasably attached to the adhesive areas of the display strip for protecting the adhesive areas prior to adhesion to a product.

A product shipping and display system of the invention includes a plurality of products each being generally elongate and having a longitudinal extent defining a length. The products are arrayed in a line along the display strip with the longitudinal extent of the products being generally aligned with the longitudinal axis of the display strip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new product shipping and display strip system which has many of the advantages of the devices for arranging and displaying objects mentioned heretofore and many novel features that result in a new product shipping and display strip system which is not anticipated, rendered obvious, suggested, or even implied by any of the prior art devices for arranging and displaying objects, either alone or in any combination thereof.

It is another object of the present invention to provide a new product shipping and display strip system which may be easily and efficiently manufactured and marketed.

A further object of the present invention is to provide a new product shipping and display strip system which is susceptible of a low cost of manufacture with regard to both materials and labor, and which accordingly is then susceptible of low prices of sale to the consuming public, thereby making such product shipping and display strip system economically available to manufacturers of products and retailers for displaying the products to point of sale purchasers.

Still yet another object of the present invention is to provide a new product shipping and display strip system for displaying items, or product, at retail store check out counters and high traffic areas so that the products can be easily removed from the display strip for purchase.

Yet another object of the present invention is to provide a new product shipping and display strip system which includes an elongate flexible strip with an upper end designed for suspending from a structure. On the front surface of the strip are a plurality of spaced apart adhesive areas. Each of the adhesive areas has an adhesive on it for adhesively coupling an object to it.

Still yet another object of the present invention is to provide a new product shipping and display strip system that allows for a plurality of manufactured consumer products, e.g. drip oil cans, batteries, and a variety of other products (that would be pegged for impulse sales at retail stores) to be placed on a device that holds them vertically for removal and purchase by consumers.

Even still another object of the present invention is to provide a new product shipping and display strip system that eliminates the need for an item (such as cans) to be packaged, that is, carded or skin packed.

Still even yet another object of the present invention is to provide a new product shipping and display strip system that eliminates the need for a manufacturer to use special shipping containers or boxes to ship products attached to a display structure.

Even yet still another object of the present invention is to provide a new product shipping and display strip system that does not require any special or oversized cartoning because of the strips flexible strip design allows for an accordion fashion nesting of product so that the product may be packed and shipped in original master and stocking cartons. Further, the display strip system can help stabilize the products in the packaging during shipment.

Even still another object of the present invention is to provide a new product shipping and display strip system that allows display packing to be done while on the production line thereby eliminating the need for expensive off line display packaging which is traditionally labor intensive, expensive and sometimes even cost prohibitive.

Still yet another object of the present invention is to provide a new product shipping and display strip system that makes stocking and restocking of retail stores in departments and at check out lines easy thereby saving time and money.

Another object of the present invention is to provide a new product shipping and display strip system that is convenient because of its ability to quickly pull each strip from a carton with product in place for immediate consumer purchase.

Yet even still another object of the present invention is to provide a new product shipping and display strip system that allows more product to be placed on a traditional display peg or hook than conventional packaging displays.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
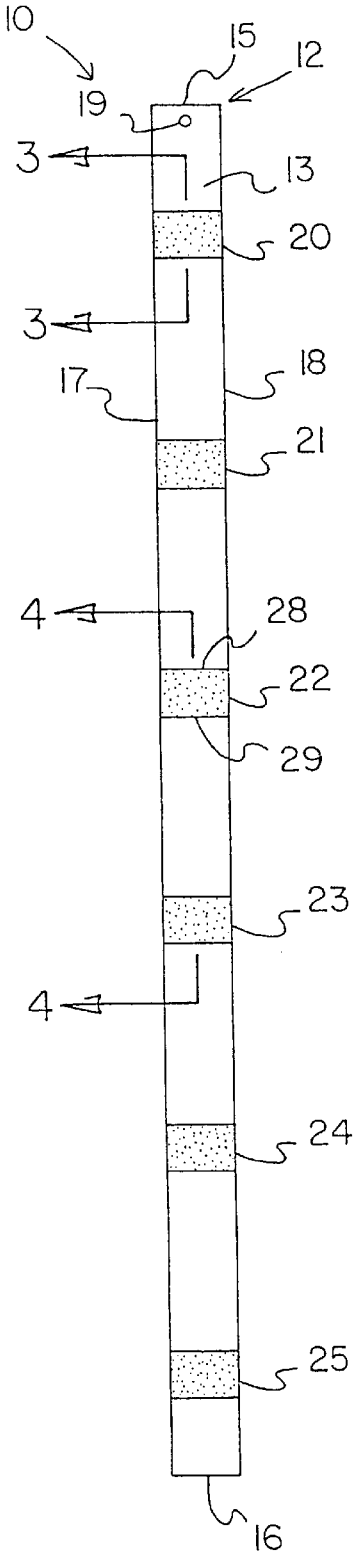
FIG. 1 is a schematic front side view of a new product shipping and strip system according to the present invention.
Figure 2:
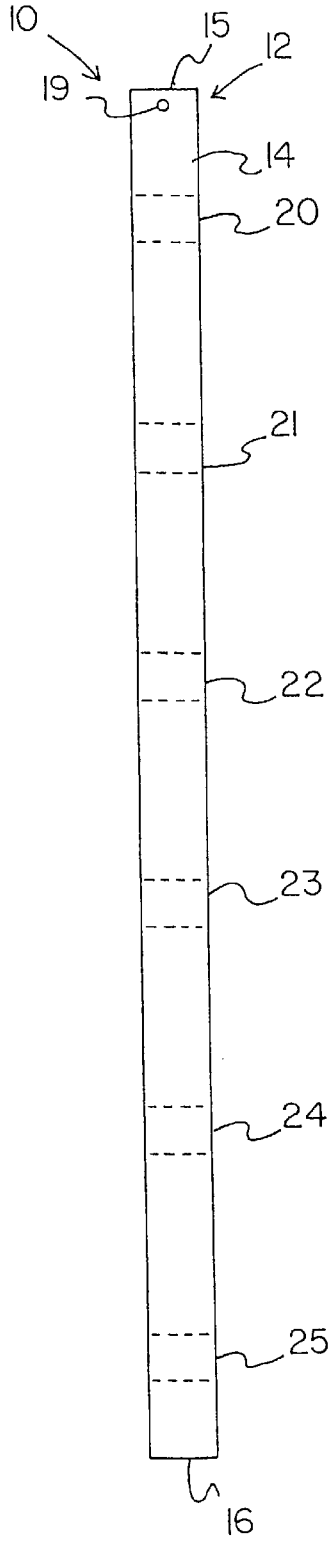
FIG. 2 is a schematic back side view of the present invention.
Figure 3:
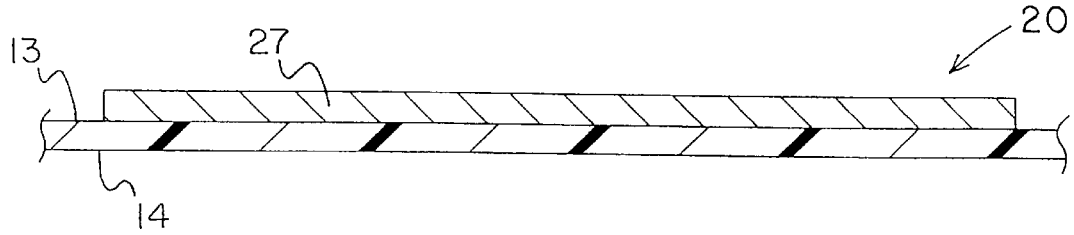
FIG. 3 is a schematic partial sectional view of the present invention illustrating an adhesive area as seen from line 3—3 of FIG. 1.
Figure 4:
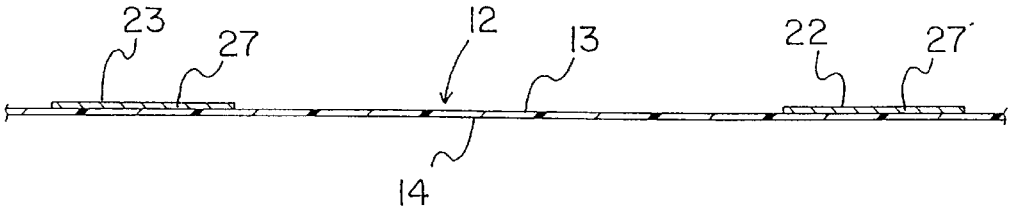
FIG. 4 is another schematic partial sectional view of the present invention taken from line 4—4 of FIG. 1.

With reference now to the drawings, and in particular to FIGS. 1 through 7 thereof, a new product shipping and display strip system embodying the principles and concepts of the present invention and generally designated by the reference numeral 10 will be described.

The product shipping and display strip system 10 is designed for attaching objects 1, or product, thereto so that the objects on the strip may be suspended from a structure such as the shelving found near the check out counter of a typical retail store. As best illustrated in FIGS. 1 through 7, the product shipping and display strip system 10 generally comprises an elongate flexible strip 12 with an upper end designed for suspending from a structure. On the front surface of the strip 12 are a plurality of spaced apart adhesive areas 20–25. Each of the adhesive areas 20–25 has an adhesive on it for adhesively coupling an object to it.

Figure 6:
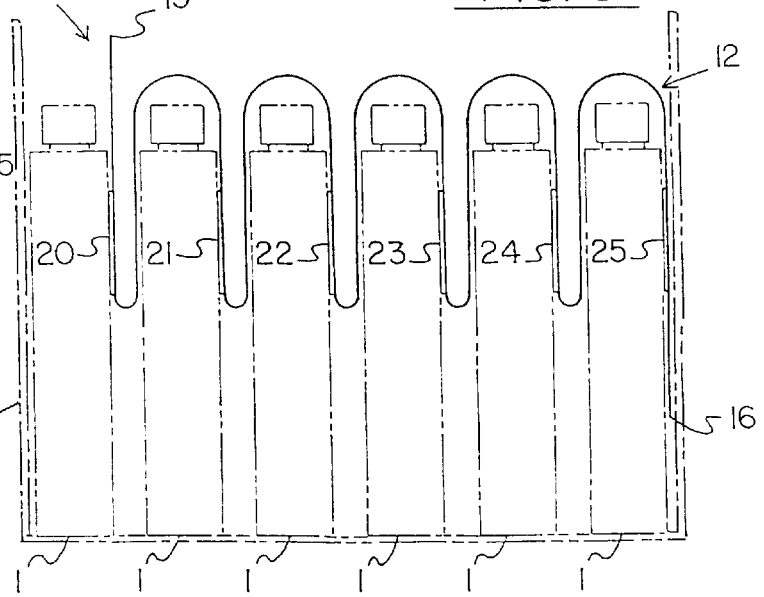
FIG. 6 is a schematic side view of the present invention in use in a folded arrangement with objects attached to the strip for convenient and secure packing of the strip and objects in a shipping container prior to display.
Figure 7:
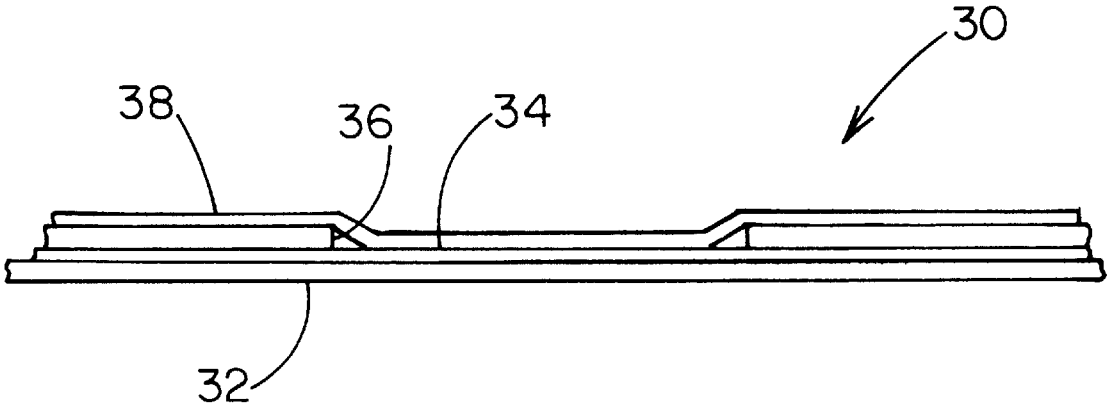
FIG. 7 is a schematic partial sectional view of an optional configuration of the present invention with shielding segments and a protective strip.

In closer detail, the elongate flexible strip 12 has front and back surfaces 13, 14. Preferably, the strip is generally rectangular and has opposite upper and lower ends 15, 16, and a pair of elongate sides 17. 18 extending between the upper and lower ends 15, 16 of the strip 12. Ideally, the strip 12 is constructed from polyester, preferably 5mm thickness polyester of the type commonly known as "MYLAR" and of the type manufactured and supplied by the company EMTECH (Emulsion Technologies, Inc, 1030 Lake Road, Medina, Ohio 44256). As illustrated in FIG. 6, the strip 12 is flexible enough to permit accordion type folding of the strip 12 when it has objects 1 attached to it so that the strip 12 and objects 1 may be easily and conveniently packed in a container such as a box.

The upper end of the strip 12 is designed for suspending from a structure. Preferably, the strip 12 has a hole 19 located towards the upper end 15 of the strip 12 which extends between the front and back surfaces 13, 14 of the strip 12. The hole 19 is designed for extending a hook or a peg through it to suspend the strip 12 from a structure. While it should be understood that the strip may be made to any suitable dimension according to the product being displayed thereon, in an illustrative ideal embodiment, the strip length (which is defined between the upper and lower ends 15, 16) is less than about 36 inches while the strip width (which is defined between the sides 17, 18 of the strip 12) is less than about 1¾ inches (such that the strip 12 about 20 times greater than the strip width). This ratio of length to width for the strip is ideal for displaying product in high traffic areas and near check out counters of retail stores.

As illustrated in the Figures, the front of the strip 12 has a plurality of spaced apart adhesive areas 20–25 each having an adhesive 27 thereon. Ideally, there are six adhesive areas 20–25 for ease of handling and for limiting the product strip 10 with objects thereon to a manageable weight. Each of the adhesive areas 20–25 is designed for adhesively coupling an object thereto for permitting display of the object on the front of the strip 12. Preferably, each of the adhesive areas 20–25 is generally rectangular and is extended between the sides 17, 18 of the strip 12 such that each of the adhesive areas 20–25 has a pair of lateral sides 28, 29 extending between the sides 17, 18 of the strip 12.

Ideally, the adhesive 27 is applied to the front surface 13 of the strip 12 such that it substantially covers each adhesive area 20–25. In the ideal embodiment, the adhesive 27 is of the type sold under the name "EMTECH Adhesive P1212" by EMTECH (Emulsion Technologies, Inc, 1030 Lake Road, Medina, Ohio 44256). This adhesive is a general purpose clear acrylic adhesive that exhibits moderate initial tack, and high shear with minimum cold flow which is ideal for application to the strip and for detachably adhering objects to the strip.

In the ideal illustrative embodiment shown in the Figures, each of the adhesive areas 20–25 has a width defined between the sides 17, 18 of the strip 12 and a length defined between the lateral sides 28, 29 of their respective adhesive area. Preferably, the width of each of the adhesive areas 20–25 is substantially equal to the strip 12 width while the length of each of the adhesive areas 20–25 is less than about 1¼ inches.

The adhesive areas 20–25 are arranged in a spaced apart series which extends between the upper and lower ends 15, 16 of the strip 12. The series of adhesive areas 20–25 has an upper terminal adhesive area 20 and a lower terminal adhesive area 25. The upper terminal adhesive area 20 is located towards the upper end 15 of the strip 12, while the lower terminal adhesive area 25 is located towards the lower end 16 of the strip 12.

Each of said adhesive areas is spaced along the longitudinal direction of said display strip by a distance between adjacent adhesive areas. Preferably, the distance between adjacent adhesive areas is adapted such that when the display strip is in a linear configuration, substantially the entire length of the products attached to the strip may abut against the display strip without adjacent products overlapping each other and thereby preventing the bending of the display strip into a serpentine condition with the products attached. This is especially important with thicker products which do not readily overlap without significantly contorting the display strip when suspended. The distance between adjacent adhesive areas is most preferably adapted to permit longitudinal spacing between adjacent products attached to the front surfaces of the display strip to increase the ease with which products may be gripped and removed from the display strip.

The length of each of the adhesive areas in the longitudinal direction of the display strip is preferably adapted to permit a portion of the display strip between adjacent products to flex away from the adjacent products into an accordion configuration. As a result, the products attached to the display strip may be positioned in a shipping box in a parallel orientation to each other with adjacent products on the display being abuttable against each other.

Illustratively, the space between each adjacent pair of adhesive areas (20, 21 for example) is less than about 4¾ inches as preferably measured between the higher lateral side of the lower adhesive area 21 and the lower lateral side of the upper adhesive area 20 of the pair of adhesive areas 20, 21. In other words, the space from the upper lateral side of the higher adhesive area to the upper lateral side of the lower adhesive area is less than about 6 inches. In this preferred embodiment, ideally the distance between the upper terminal adhesive area and the upper end of the strip 12 is less than about 2¾ inches while the distance between the lower terminal adhesive area and the lower end of the strip 12 is less than about 2¾ inches.

One highly preferred strip structure 30 (see FIG. 7) of the invention includes the elongate flexible display strip 32 with a plurality of adhesive areas 34 on the front surface of said display strip 32. A plurality of shielding segments 36 are adhered to the front surface of the display strip 32. Each of the shielding segments being positioned between adjacent adhesive areas 34 for shielding products adhered to the adhesive areas from contact with any adhesive on the front surface of the display strip 32 between the adhesive areas. The use of the shielding segments 36 permits the application of adhesive to a larger area of the front surface of the display strip than just the adhesive areas. The space between the shielding segments defines the adhesive areas and the length of the shielding segments defines a distance between adjacent adhesive areas. An adhesive material may even be applied over substantially the entire front surface of the display strip 34 (see FIG. 7), without having an excessive area of the front surface being adhered to the products. Significantly, if too large an area of the display strip is adhered to the products, the ability to fold the strip into an accordion configuration during product shipping may be impaired and consumer removal of the products from the front surface may be made excessively difficult. In one highly preferred configuration of the invention, the adhesive areas each have a substantially equal length and the shielding segments each have a substantially equal length, and the length of the shielding segments is approximately three times the length of the adhesive areas.

A protective strip 38 is positioned adjacent to the front surface of the display strip 32 with the shielding segments being interposed between the protective strip and the display strip. The protective strip 38 is releasably attached to the adhesive areas of the display strip for protecting the adhesive areas prior to adhesion to a product. Optionally, the protective strip may have a length and width that generally corresponds to the length and width of the display strip.

Figure 5:
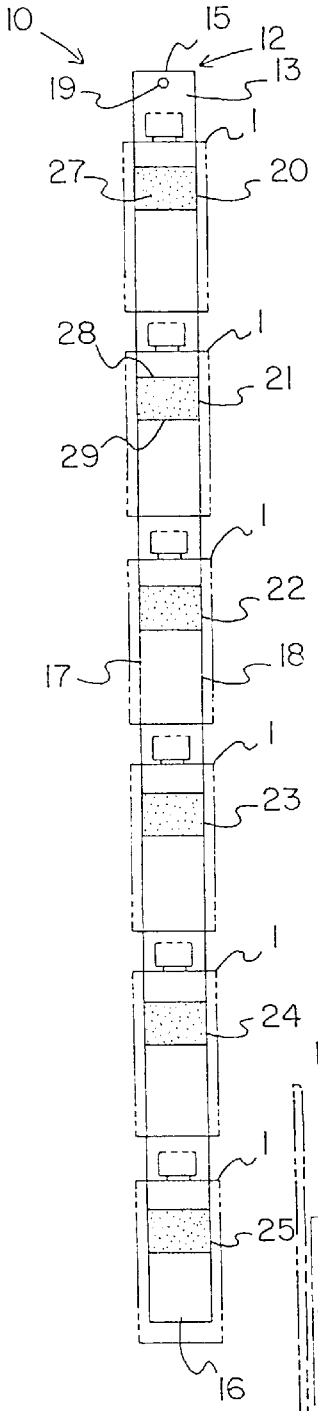
FIG. 5 is a schematic front side view of the present invention in use attached to a plurality of products for display.

In use, a plurality of objects or products 1 are attached to the adhesive areas 20–25 so that the objects may ultimately be displayed suspended on the strip from a hook or peg on a support structure as illustrated in FIG. 5. This arrangement allows a consumer to easily remove an object from the strip as desired when the strip is suspended from the support structure.

This invention also permits a manufacturer to easily and cheaply pack objects 1 all ready for display (without the need for costly display packaging) in conventional storage containers such as a box by folding the strip into accordion-like folds as illustrated in FIG. 6.

Typically, each product 1 is generally elongate and has a longitudinal extent which defines a length, and the products are arrayed in a line along the display strip with the longitudinal extent of the products being generally aligned with the longitudinal axis of the display strip. Preferably, the distance between adjacent adhesive areas is adapted such that in a linear configuration, substantially the entire length of the products may abut against the display strip without adjacent products overlapping each other and thereby preventing the bending of the display strip into an accordion configuration with the products attached. The distance between adjacent adhesive areas is most preferably adapted to permit longitudinal spacing between adjacent products attached to the front surfaces of the display strip. Preferably, the length of each of the adhesive areas in the longitudinal direction of the display strip is adapted to permit a portion of the display strip between adjacent adhesive areas to flex away from the adjacent products into an accordion configuration such that products attached to the display strip may be positioned in a shipping box in a parallel orientation to each other with adjacent products on the display being abuttable against each other. (See FIG. 7)

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A product shipping and display strip for shipping and for displaying a plurality of similar products subsequent to shipping, said product shipping and display strip comprising:

an elongate flexible display strip having front and back surfaces, opposite upper and lower ends and a longitudinal axis extending between said upper and lower ends, and a pair of elongate sides being extended between said upper and lower ends of said display strip, said upper end of said display strip being for suspending from a structure, a plurality of adhesive areas on the front surface of said display strip, each of said adhesive areas being for adhesively coupling a product to said front surface such that an array of products is created along said display strip with a longitudinal extent of the products being generally aligned with the longitudinal axis of a display strip, wherein each of said adhesive areas is spaced along the longitudinal direction of said display strip by a distance between said adjacent adhesive areas;

wherein the distance between adjacent adhesive areas is adapted such that in a linear configuration, substantially the entire length of the products may abut against the display strip without adjacent products overlapping each other and thereby preventing the bending of said display strip into a accordion condition with said products adapted to be attached thereto, wherein the distance between adjacent adhesive areas is adapted to permit longitudinal spacing between adjacent products adapted to be attached to the front surfaces of said display strip; and wherein the length of each of said adhesive areas in the longitudinal direction of said display strip is adapted to permit a portion of said display strip between adjacent products adapted to flex away from the adjacent products into an serpentine configuration such that products adapted to be attached to said display strip positionable in a shipping box in a parallel orientation to each other with said adjacent products on said display being abuttable against each other.

2. The apparatus of claim 1 wherein said strip is generally rectangular, wherein a strip length is defined between said upper and lower ends of said strip, wherein a strip width is defined between said sides of said strip, wherein each of said adhesive areas is generally rectangular, each of said adhesive areas having a pair of lateral sides being extended between said sides of said strip, wherein each of said adhesive areas has a width being defined between said sides of said strip, and wherein each of said adhesive areas has a length being defined between said lateral sides of their respective adhesive area.

3. The apparatus of claim 2 wherein said strip length is less than approximately 36 inches, wherein said strip width is less than approximately 1¾ inches, wherein said width of each of said adhesive areas is substantially equal to said strip width, and wherein said length of each of said adhesive areas is less than approximately 1¼ inches.

4. The apparatus of claim 1 wherein the space between each adjacent pair of adhesive areas is less than approximately 4¾ inches.

5. The apparatus of claim 1 wherein said strip has a hole extending between said front and back surfaces of said strip, said hole being located towards said upper end of said strip, said hole being for extending a hook there through to suspend said strip from the structure.

6. The apparatus of claim 1 wherein each of said adhesive areas is aligned generally parallel to each other and facing in a common direction when said strip is in a folded state.

7. A product shipping and display strip structure for attachment to a plurality of similar products for shipping and for displaying the products subsequent to shipping, said product shipping and display strip structure comprising:

an elongate flexible display strip having front and back surfaces, opposite upper and lower ends defining a length and a longitudinal axis extending between said upper and lower ends, and a pair of elongate sides being extended between said upper and lower ends of said strip and defining a width, said upper end of said display strip being for suspending from a structure, wherein a plurality of adhesive areas on the front surface of said display strip have adhesive applied to said front surface, each of said adhesive areas being for adhesively coupling a product to said front surface;

a plurality of shielding segments adhered to the display strip, each of said shielding segments being positioned between adjacent said adhesive areas for shielding products adhered to said adhesive areas from contact with any adhesive on the front surface of said display strip between said adhesive areas; and a protective strip positioned adjacent to the front surface of the display strip with said shielding segments being interposed between said protective strip and said display strip, said protective strip being releasably attached to the adhesive areas of said display strip for protecting said adhesive areas prior to adhesion to said product.

8. The product shipping and display strip structure of claim 7 wherein the adhesive areas each have a substantially equal length and the shielding segments each have a substantially equal length, and wherein the length of the shielding segments is approximately three times the length of the adhesive areas.

9. The product shipping and display strip structure of claim 7 wherein substantially the entire area of the front surface is covered with an adhesive and the space between said shielding segments defines said adhesive areas.

10. The product shipping and display strip structure of claim 7 wherein the length of the shielding segments defines a distance between adjacent adhesive areas.

11. The product shipping and display strip structure of claim 7 wherein said protective strip has a length and width generally corresponding to the length and width of said display strip.

12. A product shipping and display system for attachment to a plurality of similar products for shipping and for displaying the products subsequent to shipping, said product shipping and display system comprising:

an elongate flexible display strip having front and back surfaces, opposite upper and lower ends and a longitudinal axis extending between said upper and lower ends, and a pair of elongate sides being extended between said upper and lower ends of said display strip, said upper end of said display strip being for suspending from a structure, a plurality of areas on the front surface of said display strip having adhesive applied to said front surface, each of said adhesive areas being for adhesively coupling a product to said front surface, each of said adhesive areas being spaced along the longitudinal direction of said display strip by a distance between adjacent adhesive areas; and a plurality of products, each product being generally elongate and having a longitudinal extent defining a length, the products being arrayed in a line along said display strip with the longitudinal extent of the products being generally aligned with the longitudinal axis of the display strip;

wherein the distance between adjacent adhesive areas is adapted such that in a linear configuration, substantially the entire length of the products may abut against the display strip without adjacent products overlapping each other and thereby preventing the bending of said display strip into an accordion configuration with said products attached.

13. The product shipping and display system of claim 12 wherein the distance between adjacent adhesive areas is adapted to permit longitudinal spacing between adjacent products attached to the front surfaces of said display strip.

14. The product shipping and display system of claim 12 wherein the length of each of said adhesive areas in a longitudinal direction of said display strip is adapted to permit a portion of said display strip between adjacent adhesive areas to flex away from the adjacent products into an accordion configuration such that products attached to said display strip positionable in a shipping box in a parallel orientation to each other with said adjacent products on said display being abuttable against each other.

* * * * *